US010260697B2

(12) United States Patent
Yamamoto

(10) Patent No.: US 10,260,697 B2
(45) Date of Patent: Apr. 16, 2019

(54) VEHICLE LAMP HAVING INTEGRAL PROJECTION LENSES AND A PRIMARY ARRAY OF LIGHT EMITTING ELEMENTS ARRANGED ON COMMON SUPPORT WITH APERTURES AND A SECONDARY ARRAY OF LIGHT EMITTING ELEMENTS ARRANGED BEHIND APERTURES

(71) Applicant: KOITO MANUFACTURING CO., LTD., Minato-ku, Tokyo (JP)

(72) Inventor: Ippei Yamamoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 40 days.

(21) Appl. No.: 15/435,427

(22) Filed: Feb. 17, 2017

(65) Prior Publication Data

US 2017/0241605 A1 Aug. 24, 2017

(30) Foreign Application Priority Data

Feb. 18, 2016 (JP) ..... 2016-029165
Feb. 18, 2016 (JP) ..... 2016-029166

(51) Int. Cl.
*F21S 41/19* (2018.01)
*F21S 41/25* (2018.01)
(Continued)

(52) U.S. Cl.
CPC ..... *F21S 41/25* (2018.01); *F21S 41/141* (2018.01); *F21S 41/143* (2018.01);
(Continued)

(58) Field of Classification Search
CPC ..... F21S 41/25; F21S 41/143; F21S 41/148; F21S 41/40; F21S 41/151
See application file for complete search history.

(56) References Cited

U.S. PATENT DOCUMENTS 6,789,921 B1 * 9/2004 Deloy ..... G02F 1/133603 362/97.3
7,924,371 B1 * 4/2011 Davis ..... G02F 1/133603 349/61
(Continued)

FOREIGN PATENT DOCUMENTS

EP 1600689 A1 11/2005
JP 2004-327188 A 11/2004
(Continued)

OTHER PUBLICATIONS

Communication dated Jan. 11, 2019, from the State Intellectual Property Office of People's Republic of China in counterpart Application No. 201710083612.5.
(Continued)

*Primary Examiner* — Jong-Suk (James) Lee
*Assistant Examiner* — Christopher E Dunay
(74) *Attorney, Agent, or Firm* — Sughrue Mion, PLLC

(57) ABSTRACT

A vehicle lamp includes a plurality of projection lenses arranged in parallel in a certain direction intersecting a vehicle longitudinal direction, a plurality of first light emitting elements arranged behind the plurality of projection lenses, a common light source support member configured to support the plurality of first light emitting elements, the light source support member including at least one translucent part, and at least one second light emitting element disposed behind the common light source support member. A first light distribution pattern is formed by irradiating a direct light from each of the first light emitting elements toward the front through each of the projection lenses. A second light distribution pattern is formed by irradiating the light emitted from the at least one second light emitting element toward the front through the at least one translucent part and any one of the plurality of projection lenses.

8 Claims, 14 Drawing Sheets

(51) Int. Cl.

| | |
|---|---|
| ***F21S 41/40*** | (2018.01) |
| ***F21S 41/141*** | (2018.01) |
| ***F21S 41/143*** | (2018.01) |
| ***F21S 41/36*** | (2018.01) |
| ***F21S 41/663*** | (2018.01) |
| ***F21S 45/47*** | (2018.01) |
| ***F21S 41/33*** | (2018.01) |
| ***F21S 41/148*** | (2018.01) |
| ***F21S 41/151*** | (2018.01) |
| *F21Y 115/10* | (2016.01) |
| *F21S 41/365* | (2018.01) |

(52) U.S. Cl.
CPC ..... *F21S 41/148* (2018.01); *F21S 41/151* (2018.01); *F21S 41/19* (2018.01); *F21S 41/338* (2018.01); *F21S 41/36* (2018.01); *F21S 41/40* (2018.01); *F21S 41/663* (2018.01); *F21S 45/47* (2018.01); *F21S 41/365* (2018.01); *F21Y 2115/10* (2016.08)

(56) References Cited

U.S. PATENT DOCUMENTS

2004/0120160 A1* 6/2004 Natsume ..... B60Q 1/0058 362/544
2007/0201241 A1 8/2007 Komatsu
2008/0049438 A1* 2/2008 Bloemen ..... B60Q 1/0052 362/540
2009/0290372 A1 11/2009 Kotajima et al.
2011/0280031 A1* 11/2011 Luger ..... F21S 48/1154 362/520
2013/0223089 A1* 8/2013 Danner ..... F21S 48/1241 362/511
2013/0242589 A1* 9/2013 Abe ..... F21S 41/147 362/512
2013/0308329 A1* 11/2013 Danner ..... F21S 41/143 362/516
2013/0343074 A1* 12/2013 Tsukamoto ..... F21V 13/04 362/511
2015/0252975 A1 9/2015 Nakada
2017/0089536 A1* 3/2017 Courcier ..... F21S 48/12
2017/0241607 A1* 8/2017 Courcier ..... F21S 48/1266
2017/0350568 A1* 12/2017 Hager ..... F21S 41/24

FOREIGN PATENT DOCUMENTS

JP 2015-170423 A 9/2015
WO 2014/164792 A1 10/2014

OTHER PUBLICATIONS

Communication dated Feb. 5, 2019, issued by the French Patent Office in counterpart French Application No. FR1751259.

* cited by examiner

VEHICLE LAMP HAVING INTEGRAL PROJECTION LENSES AND A PRIMARY ARRAY OF LIGHT EMITTING ELEMENTS ARRANGED ON COMMON SUPPORT WITH APERTURES AND A SECONDARY ARRAY OF LIGHT EMITTING ELEMENTS ARRANGED BEHIND APERTURES

CROSS-REFERENCE TO RELATED APPLICATION

The present application claims priorities from Japanese Patent Application No. 2016-029165 filed on Feb. 18, 2016 and Japanese Patent Application No. 2016-029166 filed on Feb. 18, 2016, the entire content of which is incorporated herein by reference.

BACKGROUND

Technical Field

The present invention relates to a vehicle lamp including a plurality of sets of light emitting elements and projection lenses.

There is known a vehicle lamp which includes a plurality of projection lenses arranged in parallel in a certain direction intersecting a vehicle longitudinal direction and a plurality of light emitting elements arranged behind the plurality of projection lenses and which is configured to form a required light distribution pattern by irradiating a direct light from each light emitting element toward the front through each projection lens.

"Patent Document 1" discloses a direct-projection type vehicle lamp which includes a plurality of types of projection lenses with different focal lengths, thereby forming a plurality of types of light distribution patterns.

Patent Document 1: Japanese Patent Laid-Open Publication No. 2004-327188

The vehicle lamp disclosed in the "Patent Document 1" has a configuration that a plurality of projection lenses for forming a first light distribution pattern and a plurality of projection lenses for forming a second light distribution pattern are arranged in parallel. Therefore, a large number of projection lenses are required, and thus, an arrangement space thereof becomes large. For this reason, it is difficult to compactly configure a vehicle lamp.

SUMMARY

Exemplary embodiments of the invention provide a vehicle lamp which includes a plurality of sets of light emitting elements and projection lenses for forming a first light distribution pattern and which is capable of forming a second light distribution pattern with a compact configuration.

The present invention is intended to achieve the above object by devising the arrangement of light emitting elements and the configuration of light source support members.

A vehicle lamp according to an exemplary embodiment, comprises:

a plurality of projection lenses arranged in parallel in a certain direction intersecting a vehicle longitudinal direction;

a plurality of first light emitting elements arranged behind the plurality of projection lenses in the vehicle longitudinal direction;

a common light source support member configured to support the plurality of first light emitting elements, the light source support member including at least one translucent part; and at least one second light emitting element disposed behind the common light source support member in the vehicle longitudinal direction, wherein a first light distribution pattern is formed by irradiating a direct light from each of the first light emitting elements toward the front through each of the projection lenses, and wherein a second light distribution pattern is formed by irradiating the light emitted from the at least one second light emitting element toward the front through the at least one translucent part and any one of the plurality of projection lenses.

A vehicle lamp according to an exemplary embodiment, comprises:

a plurality of projection lenses arranged in parallel in a certain direction intersecting a vehicle longitudinal direction and configured as a single transparent member;

a plurality of first light emitting elements arranged behind the plurality of projection lenses in the vehicle longitudinal direction;

at least one second light emitting element disposed behind the plurality of first light emitting elements in the vehicle longitudinal direction, wherein a first light distribution pattern is formed by irradiating a direct light from each of the first light emitting elements toward the front through each of the projection lenses, and wherein second light distribution pattern is formed by irradiating the light emitted from the at least one second light emitting element toward the front through any one of the plurality of projection lenses.

The "certain direction" is not limited to a specific direction, so long as it intersects a vehicle longitudinal direction.

The specific number of the "plurality of projection lenses" and the "plurality of first light emitting elements" is not particularly limited.

The specific configurations such as the material or shape of the "light source support members" are not particularly limited.

The "light emitted from the second light emitting elements" may be a direct light from the second light emitting elements or may be a light which is emitted from the second light emitting elements and then controlled by a reflector or a lens or the like.

The specific configuration of the "translucent part" is not particularly limited, so long as it allows the light emitted from the second light emitting element to be transmitted therethrough. For example, it is possible to employ a configuration that a through hole or a notch portion is formed in a portion of the light source support member or a configuration that a portion of the light source support member is formed as a transparent body, or the like.

The type of each of the "first light distribution pattern" and the "second light distribution pattern" is not particularly limited. For example, a low-beam light distribution pattern or a light distribution pattern for forming a part thereof, a high-beam light distribution pattern or a light distribution pattern for forming a part thereof, a light distribution pattern for a daytime running lamp, and a light distribution pattern for a fog lamp, etc., can be employed.

The specific shape of the "plurality of projection lenses" is not particularly limited, so long as it is configured as a single transparent member.

The vehicle lamp according to the present invention is configured to form a first light distribution pattern by irradiating a direct light from each of a plurality of first light emitting elements toward the front through each of a plurality of projection lenses. At least one second light emitting element is disposed behind a common light source support member for supporting the plurality of first light emitting elements, and at least one translucent part is formed in the light source support member. Further, the vehicle lamp is configured to form a second light distribution pattern by irradiating the light emitted from the at least one second light emitting element toward the front through the at least one translucent part and any one of the plurality of projection lenses.

Further, the vehicle lamp according to the present invention is configured to form a first light distribution pattern by irradiating a direct light from each of a plurality of first light emitting elements toward the front through each of a plurality of projection lenses. The plurality of projection lenses is configured as a single transparent member, and at least one second light emitting element is disposed behind the plurality of first light emitting elements. The vehicle lamp is configured to form a second light distribution pattern by irradiating the light emitted from the at least one second light emitting element toward the front through any one of the plurality of projection lenses.

With these configurations, the following operational effects can be obtained.

Namely, since the vehicle lamp is configured to form the second light distribution pattern by using the plurality of projection lenses for forming the first light distribution pattern, its arrangement space can be reduced, and thus, it can be made compact, as compared to a related-art case where the plurality of projection lenses for forming the first light distribution pattern and the plurality of projection lenses for forming the second light distribution pattern are arranged in parallel.

In this way, according to the present invention, the vehicle lamp which includes a plurality of sets of first light emitting elements and projection lenses for forming the first light distribution pattern is capable of forming the second light distribution pattern with a compact configuration.

Moreover, in the present invention, a plurality of first light emitting elements is supported on the common light source support member. Therefore, it is possible to reduce the number of parts, and also, it is possible to improve the positional relationship accuracy among the first light emitting elements.

In the above configuration, each of the at least one translucent part is constituted by a through-hole formed in the light source support member. Then, it is possible to obtain the above operational effects while improving the heat dissipation of the light source support member and maintaining the strength thereof.

In the above configuration, the at least one second light emitting element is constituted by a plurality of second light emitting elements arranged in parallel in the certain direction, and the at least one translucent part is constituted by a plurality of translucent parts arranged in parallel in the certain direction. Then, it is possible to form the second light distribution pattern as a bright light distribution pattern while maintaining the vehicle lamp in a compact configuration.

Further, in the present invention, the plurality of projection lenses is configured as a single transparent member. Therefore, it is possible to reduce the number of parts, and also, it is possible to improve the positional relationship accuracy among the projection lenses.

In the above configuration, the single transparent member constituting the plurality of projection lenses has a front surface which is configured by a continuous curved surface or planar surface. Then, when observing the vehicle lamp from the outside, the presence of the plurality of projection lenses can be made inconspicuous, and thus, the design properties thereof can be improved.

DETAILED DESCRIPTION

Hereinafter, embodiments of the present invention will be described with reference to the drawings.

Figure 1:
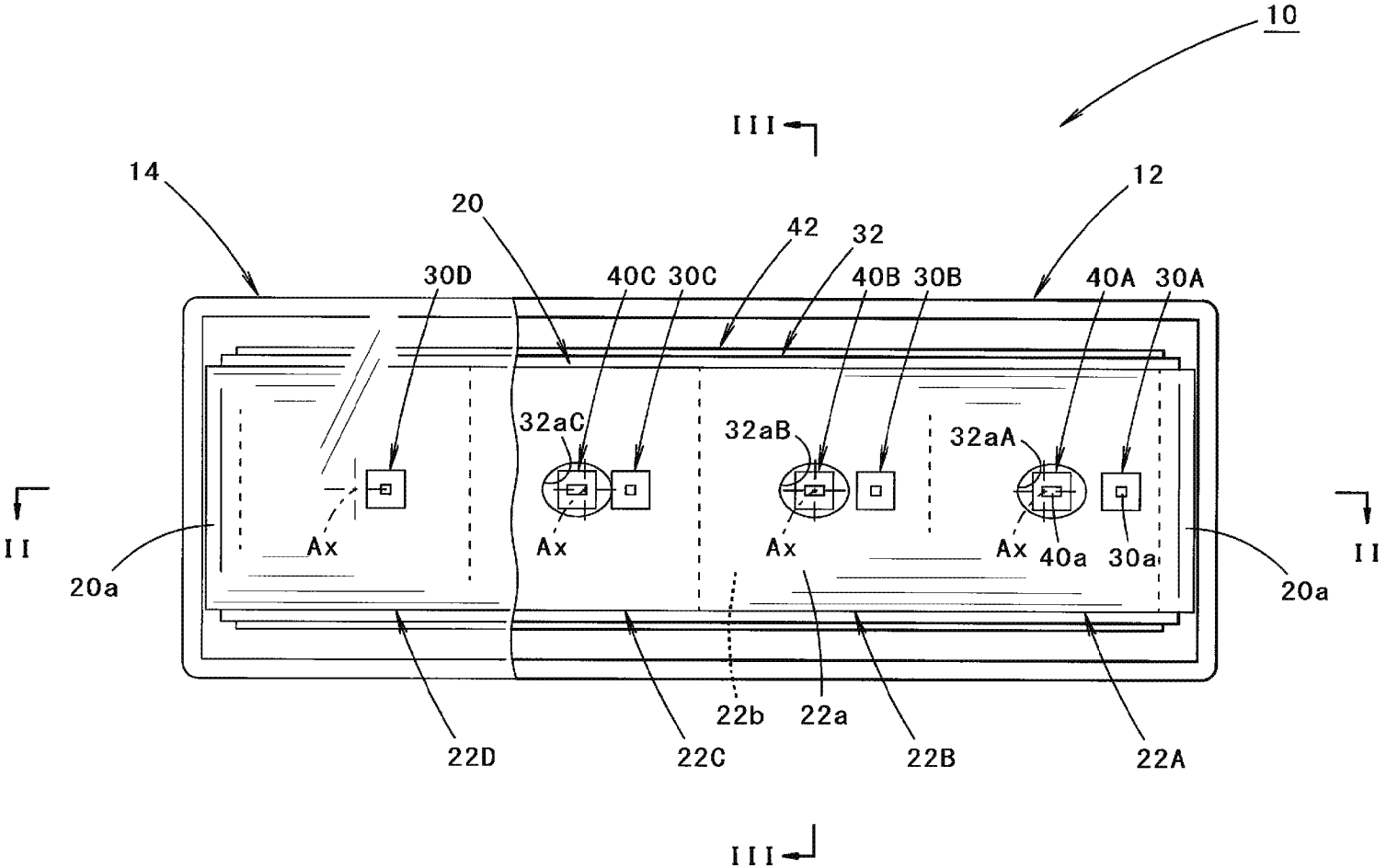
FIG. 1 is a partial sectional front view showing a vehicle lamp according to one embodiment of the present invention.

FIG. 1 is a partial sectional front view showing a vehicle lamp 10 according to one embodiment of the present invention. Further, FIG. 2 is a sectional view taken along a line II-II shown in FIG. 1, and FIG. 3 is a sectional view taken along a line shown in FIG. 1.

As shown in these figures, the vehicle lamp 10 according to the present embodiment is a headlamp disposed at a right front end portion of a vehicle and is configured to form a high-beam light distribution pattern and a light distribution pattern in which a portion of the high-beam light distribution pattern is missed.

Figure 2:
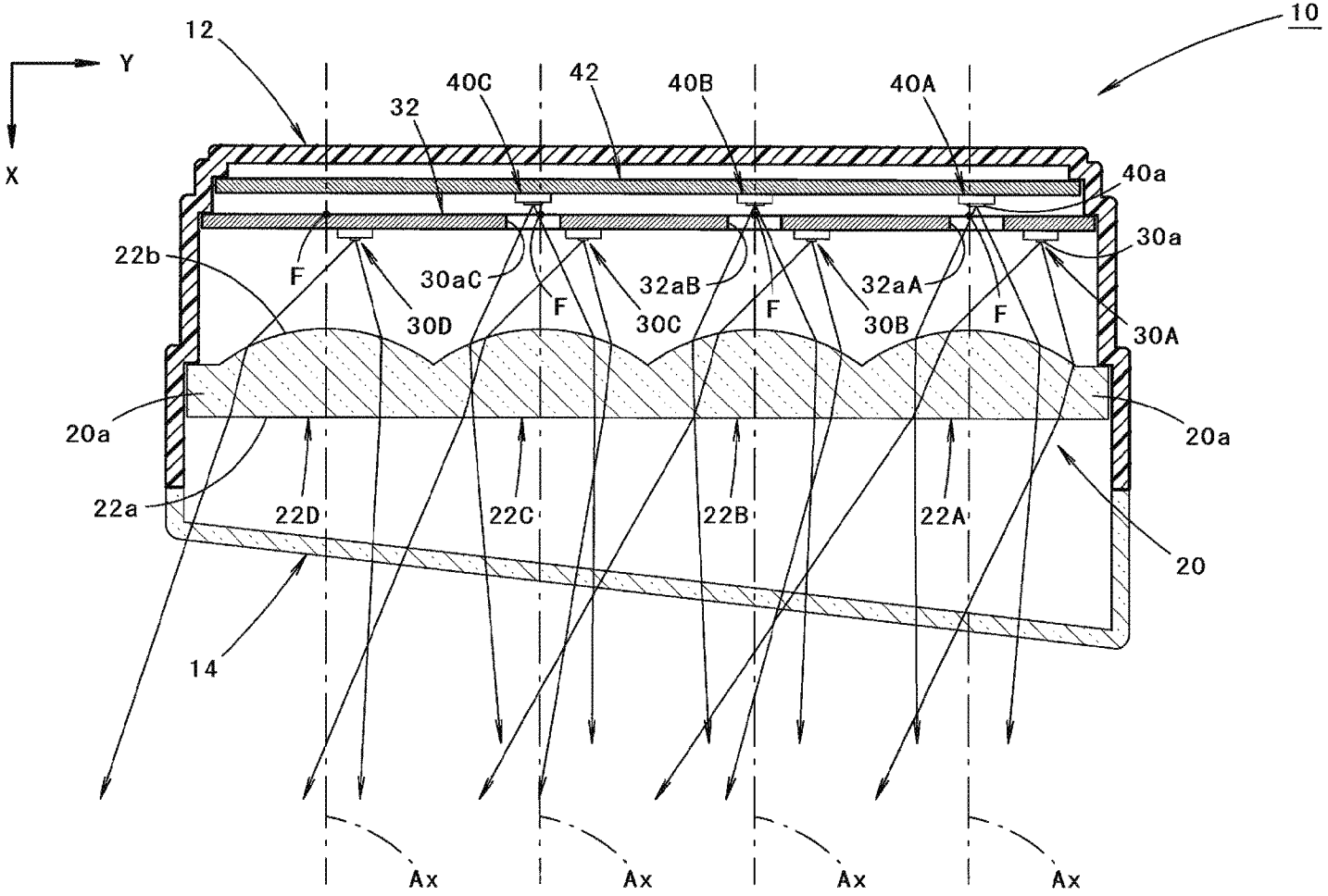
FIG. 2 is a sectional view taken along a line II-II shown in FIG. 1.
Figure 3:
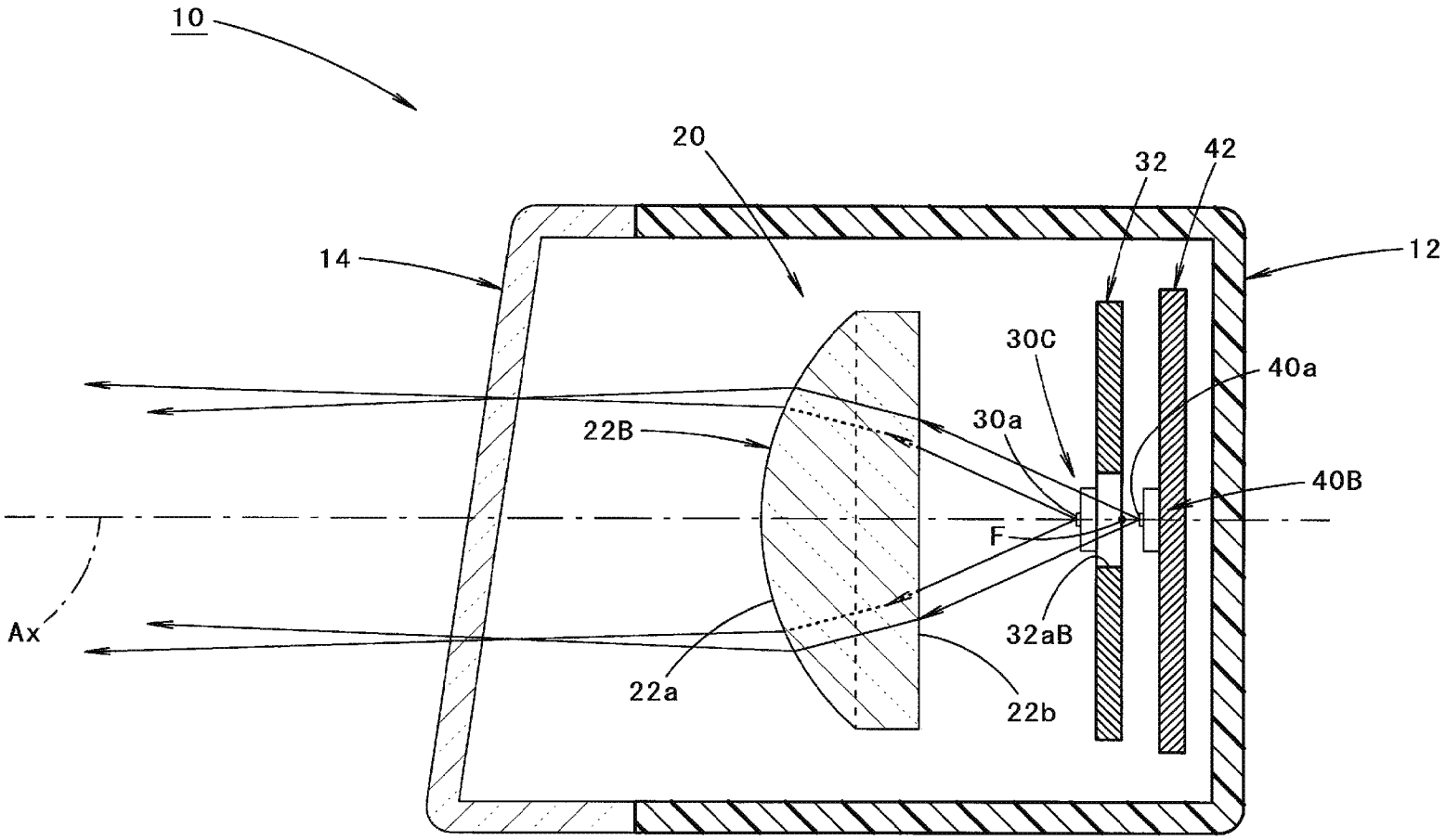
FIG. 3 is a sectional view taken along a line shown in FIG. 1.

Meanwhile, for the vehicle lamp 10, in FIG. 2, a direction indicated by "X" is a "front direction" ("front direction" also for the vehicle), and a direction indicated by "Y" is a "left direction" ("left direction" also for the vehicle but a "right direction" as seen in a front view of the lamp) perpendicular to the "front direction."

The vehicle lamp 10 has a configuration that four projection lenses 22A, 22B, 22C, 22D, four first light emitting elements 30A, 30B, 30C, 30D arranged behind these four projection lenses 22A to 22D, a common light source support member 32 for supporting these four first light emitting elements 30A to 30D, three second light emitting elements 40A, 40B, 40C arranged behind the light source support member 32, and a common light source support member 42 for supporting these three second light emitting elements 40A to 40C are incorporated in a lamp chamber which is defined by a lamp body 12 and a translucent cover 14 attached to a front end opening of the lamp body 12.

Figure 4:
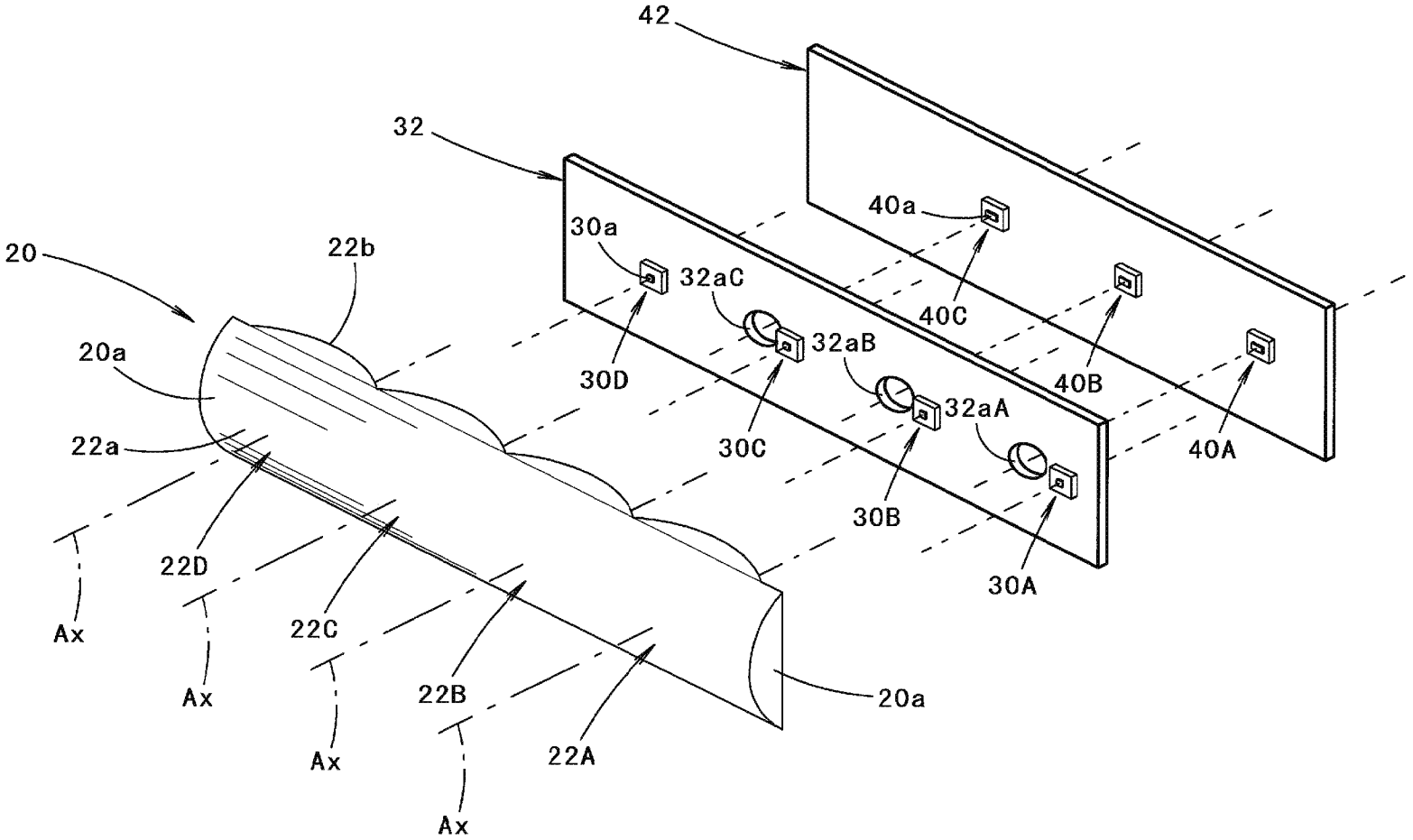
FIG. 4 is an exploded perspective view showing main components of the vehicle lamp.

FIG. 4 is an exploded perspective view showing the main components of the vehicle lamp 10.

As also shown in FIG. 4, the four projection lenses 22A to 22D are configured as a single transparent member 20. These four projection lenses 22A to 22D are arranged side by side in a vehicle width direction and all of them have the same configuration.

Specifically, each of the projection lenses 22A to 22D has a front surface 22*a* which is configured as a convex cylindrical surface extending in the vehicle width direction and a rear surface 22*b* which is configured as a convex cylindrical surface extending in a vertical direction. At that time, a vertical sectional shape of the front surface 22*a* and a horizontal sectional shape of the rear surface 22*b* are set to curved shapes having the same curvature.

Each of the projection lenses 22A to 22D has an optical axis Ax extending in a vehicle longitudinal direction so as to pass through a center position in the vertical direction of the front surface 22*a* and a center position in the vehicle width direction of the rear surface 22*b*.

A front surface of the transparent member 20 is configured as a single convex cylindrical surface in which the front surfaces 22*a* of the four projection lenses 22A to 22D are continuous. The transparent member 20 has flange portions 20*a* at opposite sides in the vehicle width direction of the four projection lenses 22A to 22D and is supported on the lamp body 12 at these flange portions 20*a*.

The four first light emitting elements 30A to 30D are arranged side by side in the vehicle width direction and all of them have the same configuration.

Specifically, each of the first light emitting elements 30A to 30D is a white light emitting diode having a substantially square light emitting surface 30*a* and is mounted on the light source support member 32 in the state where its light emitting surface 30*a* is oriented toward the front of the vehicle on a slightly front side of a rear focal point F of each of the projection lenses 22A to 22D.

The light source support member 32 is configured as a metallic support substrate extending along a vertical plane orthogonal to the optical axis Ax and also functions as a heat sink. The light source support member 32 is formed in a horizontally long rectangular shape, as seen in a front view of the lamp. The light source support member 32 has a lateral width slightly smaller than the transparent member 20 and a vertical width slightly larger than the transparent member 20. Further, the light source support member 32 is supported on the lamp body 12 at both left and right ends thereof.

The four first light emitting elements 30A to 30D are arranged in a state of being displaced to the inner side (i.e., to the left side) in the vehicle width direction relative to respective optical axes Ax of the four projection lenses 22A to 22D. At that time, the lateral displacement amount of each of the first light emitting elements 30A to 30D from the optical axis Ax is set in such a way that it is the largest in the first light emitting element 30A located on the innermost side in the vehicle width direction and gradually decreases in the order of the first light emitting elements 30B, 30C, 30D toward the outer side in the vehicle width direction.

The three second light emitting elements 40A to 40C are arranged in parallel in the vehicle width direction and all of them have the same configuration.

Specifically, each of the second light emitting elements 40A to 40C is a white light emitting diode having a horizontally long rectangular light emitting surface 40*a* and is mounted on the light source support member 42 in the state where its light emitting surface 40*a* is oriented toward the front of the vehicle.

The light source support member 42 is configured as a metallic support substrate extending along a vertical plane orthogonal to the optical axis Ax and also functions as a heat sink. The light source support member 42 is formed in a horizontally long rectangular shape, as seen in the front view of the lamp. The light source support member 42 has a lateral width slightly smaller than the light source support member 32 and a vertical width slightly larger than the light source support member 32. Further, the light source support member 42 is supported on the lamp body 12 at both left and right ends thereof.

The three second light emitting elements 40A to 40C are disposed at positions corresponding to the three projection lenses 22A to 22C closer to the inner side in the vehicle width direction.

At that time, each of the second light emitting elements 40A to 40C is mounted on the light source support member 42 in the state where its light emitting surface 40*a* is oriented toward the front of the vehicle on a slightly rear side of the rear focal point F of each of the projection lenses 22A to 22C. Namely, the rearward displacement amount of the light emitting surface 40*a* of each of the second light emitting elements 40A to 40C from the rear focal point F is set to a value smaller than the forward displacement amount of the light emitting surface 30*a* of each of the first light emitting elements 30A to 30D from the rear focal point F.

Out of these three second light emitting elements 40A to 40C, the second light emitting element 40B located in the center is disposed on the optical axis Ax of the 2nd projection lens 22B from the inner side in the vehicle width direction, the second light emitting element 40A located in the inner side in the vehicle width direction is disposed in a state of being slightly displaced to the inner side in the vehicle width direction with respect to the optical axis Ax of the 1st projection lens 22A from the inner side in the vehicle width direction, and the second light emitting element 40C located in the outer side in the vehicle width direction is disposed in a state of being slightly displaced to the outer side in the vehicle width direction with respect to the optical axis Ax of the 3rd projection lens 22C from the inner side in the vehicle width direction.

The light source support member 32 is formed with translucent parts 32*a*A, 32*a*B, 32*a*C at three places at intervals in the vehicle width direction. The translucent parts 32*a*A, 32*a*B, 32*a*C allow the light emitted from each of the second light emitting elements 40A to 40C to be transmitted forward therethrough and thus to be inputted on each of the projection lenses 22A to 22C. These three translucent parts 32*a*A to 32*a*C are formed as through-holes each having a horizontally oblong opening shape and have the same opening shape.

The vehicle lamp 10 according to the present embodiment is configured such that the four first light emitting elements 30A to 30D are simultaneously or selectively turned on and the three second light emitting elements 40A to 40C are simultaneously turned on.

Figure 5A:
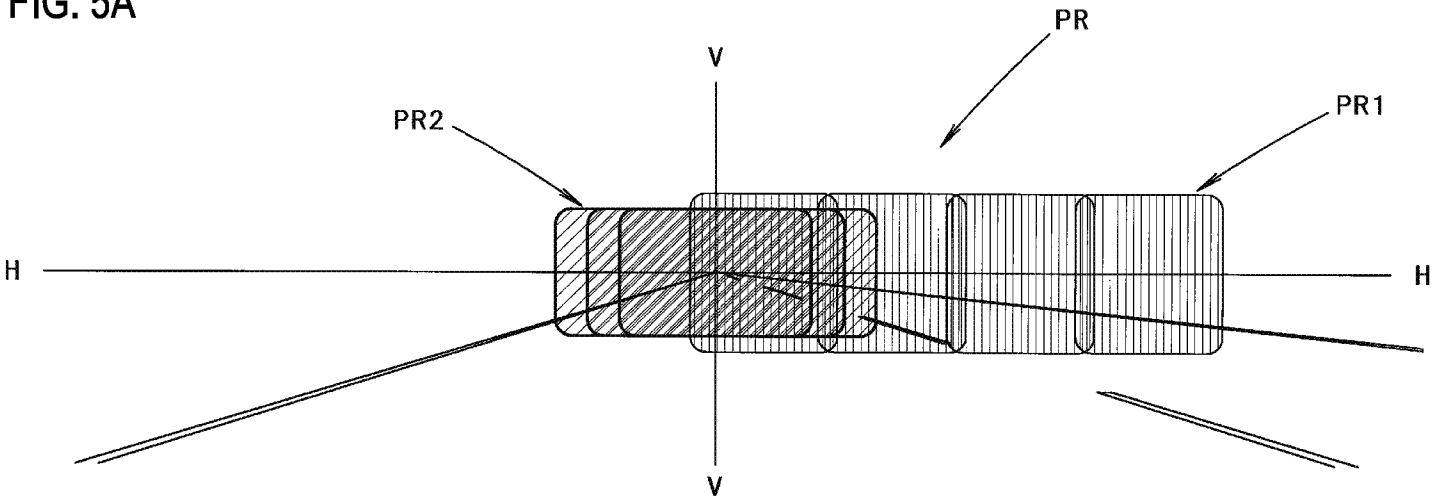
FIG. 5A is a view perspectively showing a high-beam light distribution pattern formed by an irradiation light from the vehicle lamp.

FIG. 5A is a view perspectively showing a high-beam light distribution pattern PR which is formed on a virtual vertical screen disposed at a position of 25 m in front of the lamp by the irradiation light from the vehicle lamp 10.

Figure 5B:
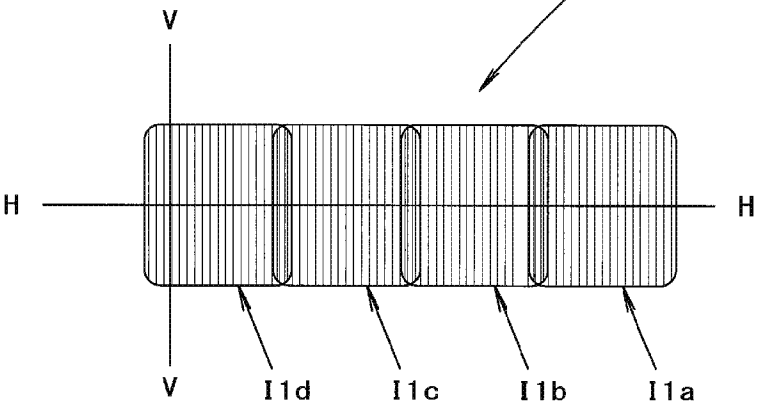
FIGS. 5B and 5C are views showing the high-beam light distribution pattern in an exploded manner.
Figure 5C:
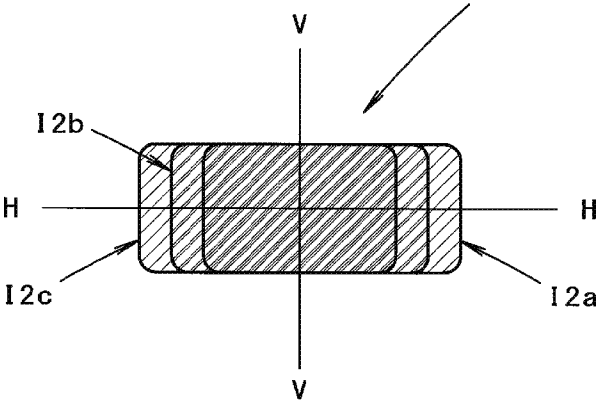

The high-beam light distribution pattern PR is formed as a combined light distribution pattern of a first light distribution pattern PR1 shown in FIG. 5B and a second light distribution pattern PR2 shown in FIG. 5C.

The first light distribution pattern PR1 shown in FIG. 5B is a light distribution pattern which is formed when the four first light emitting elements 30A to 30D are simultaneously turned on. The first light distribution pattern PR1 is composed of four light source images I1*a*, I1*b*, I1*c*, I1*d*.

Each of the light source images I1*a* to I1*d* is formed as a light distribution pattern having a substantially square outer shape by causing the light emitting surface 30*a* of each of the first light emitting elements 30A to 30D to be invertedly projected by each of the projection lenses 22A to 22D.

The four light source images I1*a* to I1*d* are formed in a state of being arranged in the lateral direction so as to vertically straddle a line H-H horizontally passing through a point H-V that is a vanishing point in a lamp front direction. At that time, these four light source images I1*a* to I1*d* are configured such that a left end portion of the light source image I1*d* located at the leftmost side intersects a line V-V vertically passing the point H-V and both left and right ends of the light source images I1*a* to I1*d* adjacent to each other are partially overlapped with each other.

The reason is that the light emitting surface 30*a* of each of the first light emitting elements 30A to 30D is located on a slightly front side of the rear focal point F of each of the projection lenses 22A to 22D and the displacement amount to the inner side in the vehicle width direction of each light emitting surface 30*a* relative to the optical axis Ax of each of the projection lenses 22A to 22D is slightly different.

The second light distribution pattern PR2 shown in FIG. 5C is a light distribution pattern which is formed when the three second light emitting elements 40A to 40C are simultaneously turned on. The second light distribution pattern PR2 is composed of three light source images I2*a*, I2*b*, I2*c*.

Each of the three light source images I2*a* to I2*c* is formed as a light distribution pattern having a substantially horizontally long rectangular outer shape by causing the light emitting surface 40*a* of each of the second light emitting elements 40A to 40C to be invertedly projected by each of the projection lenses 22A to 22C.

The three light source images I2*a* to I2*c* are formed as relatively bright light source images in a state of being arranged in the lateral direction so as to vertically straddle the line H-H. At that time, these three light source images I2*a* to I2*c* are configured such that the light source image I2*b* located at the center is formed around the line V-V and the remaining two light source images I2*a*, I2*c* are formed in a state of being slightly shifted to both left and right sides with respect to the light source image I2*b*.

The reason is that the light emitting surface 40*a* of each of the second light emitting elements 40A to 40C is disposed in a state of being slightly shifted in the vehicle width direction on a slightly rear side of the rear focal point F of each of the projection lenses 22A to 22C.

As shown in FIG. 5A, the high-beam light distribution pattern PR is formed as a light distribution pattern in which a left end portion of the first light distribution pattern PR1 is superimposed on the second light distribution pattern PR2 formed around the line V-V.

Figure 6A:
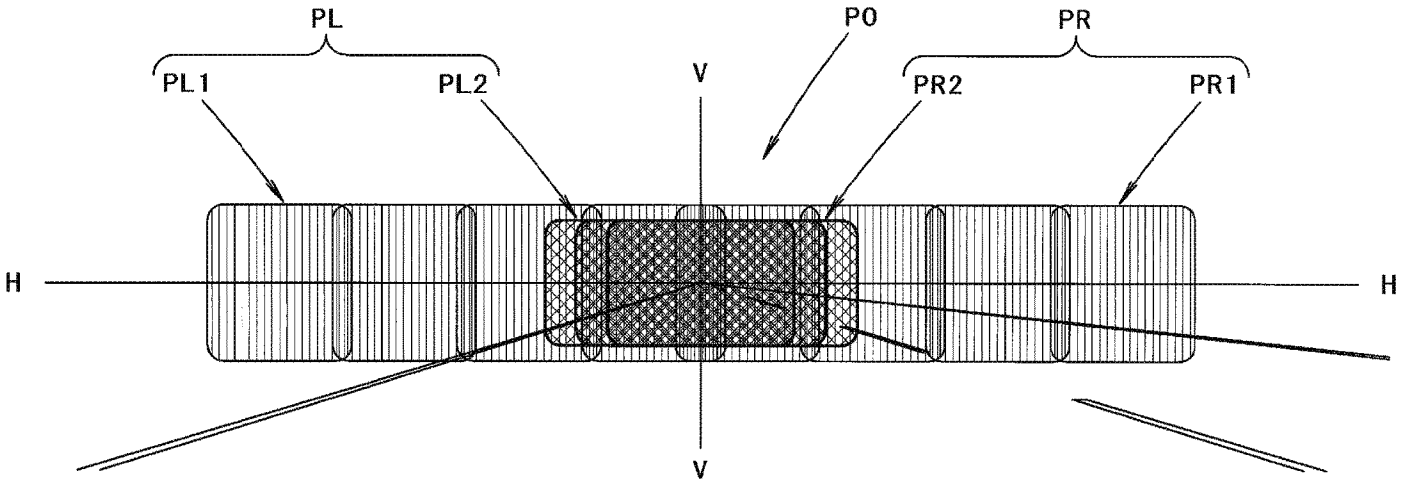
FIG. 6A is a view perspectively showing a high-beam light distribution pattern formed by an irradiation light from the vehicle lamp and a vehicle lamp paired therewith.

FIG. 6A is a view perspectively showing a high-beam light distribution pattern P0 formed in units of vehicles.

The high-beam light distribution pattern P0 is formed as a combined light distribution pattern of the high-beam light distribution pattern PR formed by the irradiation light from the vehicle lamp 10 and a high-beam light distribution pattern PL formed by the irradiation light from a vehicle lamp (i.e., a vehicle lamp positioned in the left front end portion of the vehicle and having a bilaterally symmetric configuration with respect to the vehicle lamp 10) to be paired with the vehicle lamp 10.

As shown in FIG. 6A, the high-beam light distribution pattern P0 is formed such that a left end portion of the first light distribution pattern PR1 of the high-beam light distribution pattern PR and a right end portion of the first light distribution pattern PL1 of the high-beam light distribution pattern PL are overlapped at the position of the line V-V, thereby irradiating a travelling road in front of the vehicle widely in the lateral direction. Further, the high-beam light distribution pattern P0 is formed such that the second light distribution pattern PR2 of the high-beam light distribution pattern PR and the second light distribution pattern PL2 of the high-beam light distribution pattern PL are overlapped around the line V-V, thereby brightly irradiating a distant area of the travelling road in front of the vehicle.

Figure 6B:
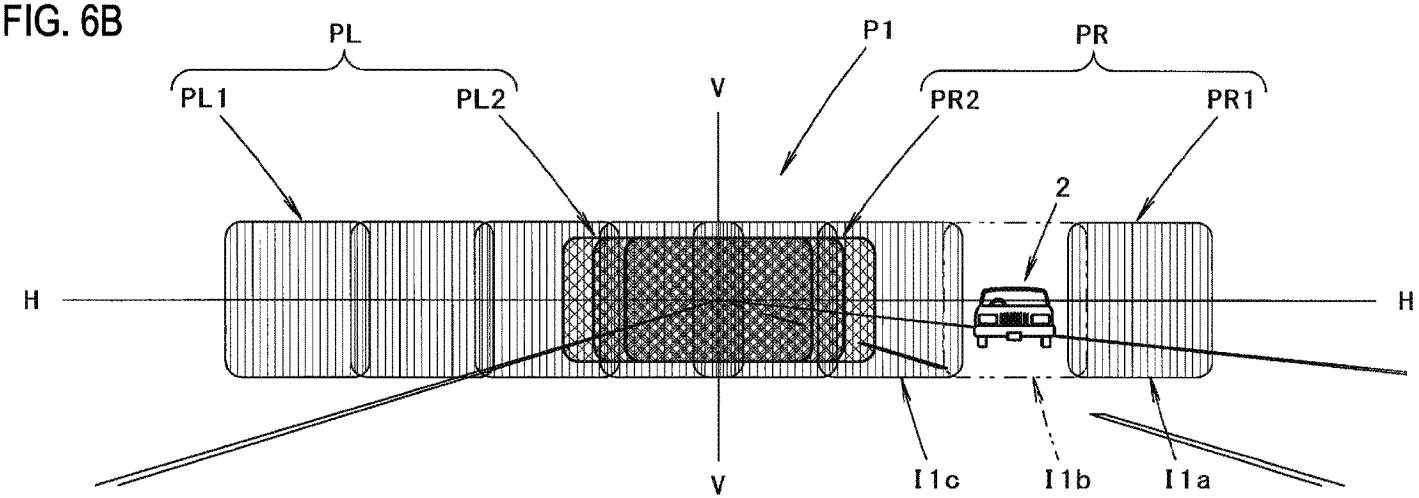
FIG. 6B is a view showing a light distribution pattern in which a portion of the high-beam light distribution pattern is missed.

A light distribution pattern P1 shown in FIG. 6B is a light distribution pattern in which a portion of the high-beam light distribution pattern P0 is missed.

That is, the light distribution pattern P1 is formed as a light distribution pattern in which a portion of the first light distribution pattern PR1 of the high-beam light distribution pattern PR in the high-beam light distribution pattern P0 is missed.

Specifically, the light distribution pattern P1 is formed such that, out of the four light source images I1*a* to I1*d* constituting the first light distribution pattern PR1, the 2nd light source image I1*b* from the right side is missed. The light distribution pattern P1 is formed by turning off the 2nd first light emitting element 30B from the inner side in the vehicle width direction, out of the four first light emitting elements 30A to 30D.

By forming the light distribution pattern P1 in which the light source image I1*b* is missed in this manner, the visibility on the travelling road in front of the vehicle is ensured by the light source images I1*a*, I1*c* located at both left and right sides thereof without giving a glare to a driver of an oncoming vehicle 2.

Next, an operational effect of the present embodiment will be described.

In the vehicle lamp 10 according to the present embodiment, four sets of first light emitting elements 30A, 30B, 30C, 30D and projection lenses 22A, 22B, 22C, 22D are arranged in parallel in the vehicle width direction. The vehicle lamp 10 is configured to form the first light distribution pattern PR1 by irradiating a direct light from each of the first light emitting elements 30A to 30D toward the front through each of the four projection lenses 22A to 22D. The three second light emitting elements 40A, 40B, 40C are disposed behind the common light source support member 32 for supporting the four first light emitting elements 30A to 30D, and the three translucent parts 32*a*A, 32*a*B, 32*a*C are formed in the light source support member 32. Further, the vehicle lamp 10 is configured to form the second light distribution pattern PR2 by irradiating the light emitted from each of the three second light emitting elements 40A to 40C toward the front through each of the three translucent parts 32*a*A to 32*a*C and three projection lenses 22A to 22C.

Further, the four projection lenses 22A to 22D are configured as the single transparent member 20.

With these configurations, the following operational effects can be obtained.

Specifically, since the vehicle lamp 10 is configured to form the second light distribution pattern PR2 by using the four projection lenses 22A to 22D for forming the first light distribution pattern PR1, its arrangement space can be reduced, and thus, it can be made compact, as compared to a related-art case where the four projection lenses 22A to 22D for forming the first light distribution pattern PR1 and new three projection lenses for forming the second light distribution pattern PR2 are arranged in parallel.

In this way, according to the present embodiment, the vehicle lamp 10 which includes the four sets of first light emitting elements 30A to 30D and projection lenses 22A to 22D for forming the first light distribution pattern PR1 is capable of forming the second light distribution pattern PR2 with a compact configuration.

At that time, it is possible to irradiate the travelling road in front of the vehicle widely in the lateral direction by the formation of the first light distribution pattern PR1. Further, it is possible to brightly irradiate a distant area of the travelling road in front of the vehicle by the formation of the second light distribution pattern PR2.

Moreover, in the present embodiment, the four first light emitting elements 30A to 30D are supported on the common light source support member 32. Therefore, it is possible to reduce the number of parts, and also, it is possible to improve the positional relationship accuracy among the first light emitting elements 30A to 30D.

Further, in the present embodiment, each of the three translucent parts 32*a*A to 32*a*C is constituted by a through-hole formed in the light source support member 32. Therefore, it is possible to obtain the above operational effects while improving the heat dissipation of the light source support member 32 and maintaining the strength thereof.

Furthermore, in the present embodiment, the three (i.e., a plurality of) second light emitting elements 40A to 40C and the three translucent parts 32*a*A to 32*a*C are arranged in parallel in the vehicle width direction. Therefore, it is possible to form the second light distribution pattern PR2 as a bright light distribution pattern while maintaining the vehicle lamp 10 in a compact configuration.

Further, in the present embodiment, the four projection lenses 22A to 22D are configured as the single transparent member 20. Therefore, it is possible to reduce the number of parts, and also, it is possible to improve the positional relationship accuracy among the projection lenses 22A to 22D. Furthermore, the front surface of the transparent member 20 is configured as a single convex cylindrical surface in which the front surfaces 22*a* of the four projection lenses 22A to 22D are continuous. Therefore, when observing the vehicle lamp 10 from the outside, the presence of the four projection lenses 22A to 22D can be made inconspicuous, and thus, the design properties thereof can be improved.

In the above embodiment, it has been described that a convex cylindrical surface constituting the front surface 22*a* of each of the projection lenses 22A to 22D and a convex cylindrical surface constituting the rear surface 22*b* thereof are set to curved shapes having the same curvature. However, these surfaces may be set to curved shapes having curvatures different from each other.

In the above embodiment, it has been described that each of the projection lenses 22A to 22D has the front surface 22*a* constituted by a convex cylindrical surface extending in the vehicle width direction and the rear surface 22*b* constituted by a convex cylindrical surface extending in the vertical direction. However, other configurations (e.g., a plano-convex lens or a bi-convex lens, etc.) may be employed.

In the above embodiment, it has been described that the four sets of first light emitting elements 30A to 30D and projection lenses 22A to 22D are provided. However, three or less sets or five or more sets may be provided.

In the above embodiment, it has been described that the three second light emitting elements 40A to 40C are provided. However, two or less or four or more may be provided.

In the above embodiment, it has been described that each of the light source support members 32, 42 is configured as a metallic support substrate. However, each of these members may be configured as a resin support substrate. Also in such a configuration, each of the light source support members 32, 42 can function as a heat sink by forming a conductive pattern or the like on the surface thereof.

In the above embodiment, it has been described that all of the three translucent parts 32*a*A to 32*a*C formed in the light source support member 32 are formed as through-holes each having a horizontally oblong opening shape. However, other configurations may be employed.

Figures 7A, 7B, 7C:
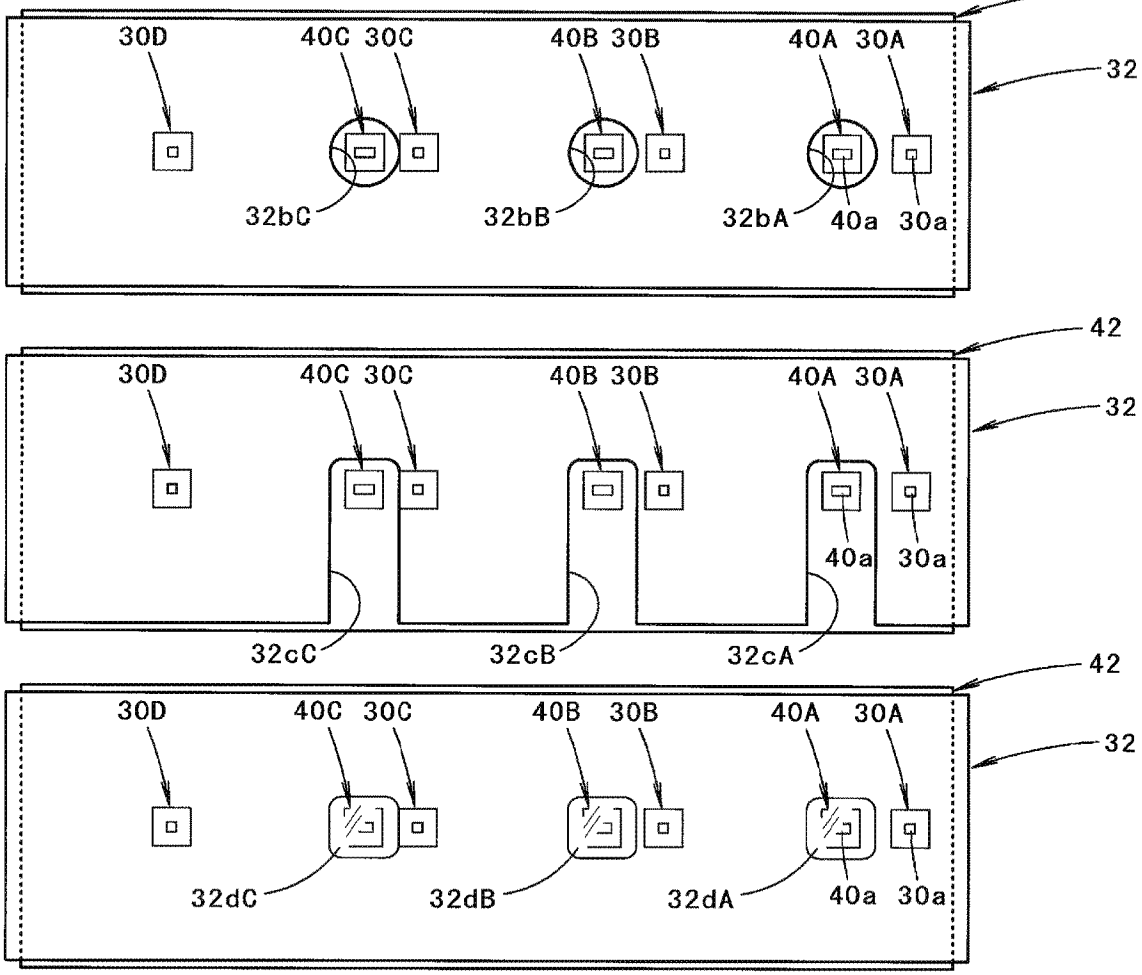
FIGS. 7A to 7C are front views showing three modifications of the light source support member in the vehicle lamp.

For example, the translucent part may be configured as a through-hole having a circular opening shape as in three translucent parts 32*b*A, 32*b*B, 32*b*C shown in FIG. 7A, or may be configured as a through-hole having other opening shapes such as a rectangle, a rhombus and a trapezoid.

Further, the translucent part may be configured as a notch portion formed in the light source support member 32, as in three translucent parts 32*c*A, 32*c*B, 32*c*C shown in FIG. 7B. Further, the translucent part may be configured as a transparent body, as in three translucent parts 32*d*A, 32*d*B, 32*d*C shown in FIG. 7C. At that time, the three translucent parts 32*d*A, 32*d*B, 32*d*C may be formed by constituting the light source support member 32 as a transparent resin support substrate, and then, forming a conductive pattern or the like on a region other than three places on the surface thereof.

In the above embodiment, the four light source images I1*a* to I1*d* are configured in a state of being formed side by side in the lateral direction by shifting the positions of the light emitting surfaces 30*a* of the four first light emitting elements 30A to 30D in the vehicle width direction. However, the four light source images I1*a* to I1*d* may be configured in a state of being formed side by side in the lateral direction by making the horizontal cross-section shapes of the rear surfaces 22*b* of the four projection lenses 22A to 22D different from each other. Further, the four light source images I1*a* to I1*d* may be configured in a state of being formed side by side in the lateral direction by a combination of both configurations.

Next, modifications of the above embodiment will be described.

First, a first modification of the above embodiment will be described.

Figure 8:
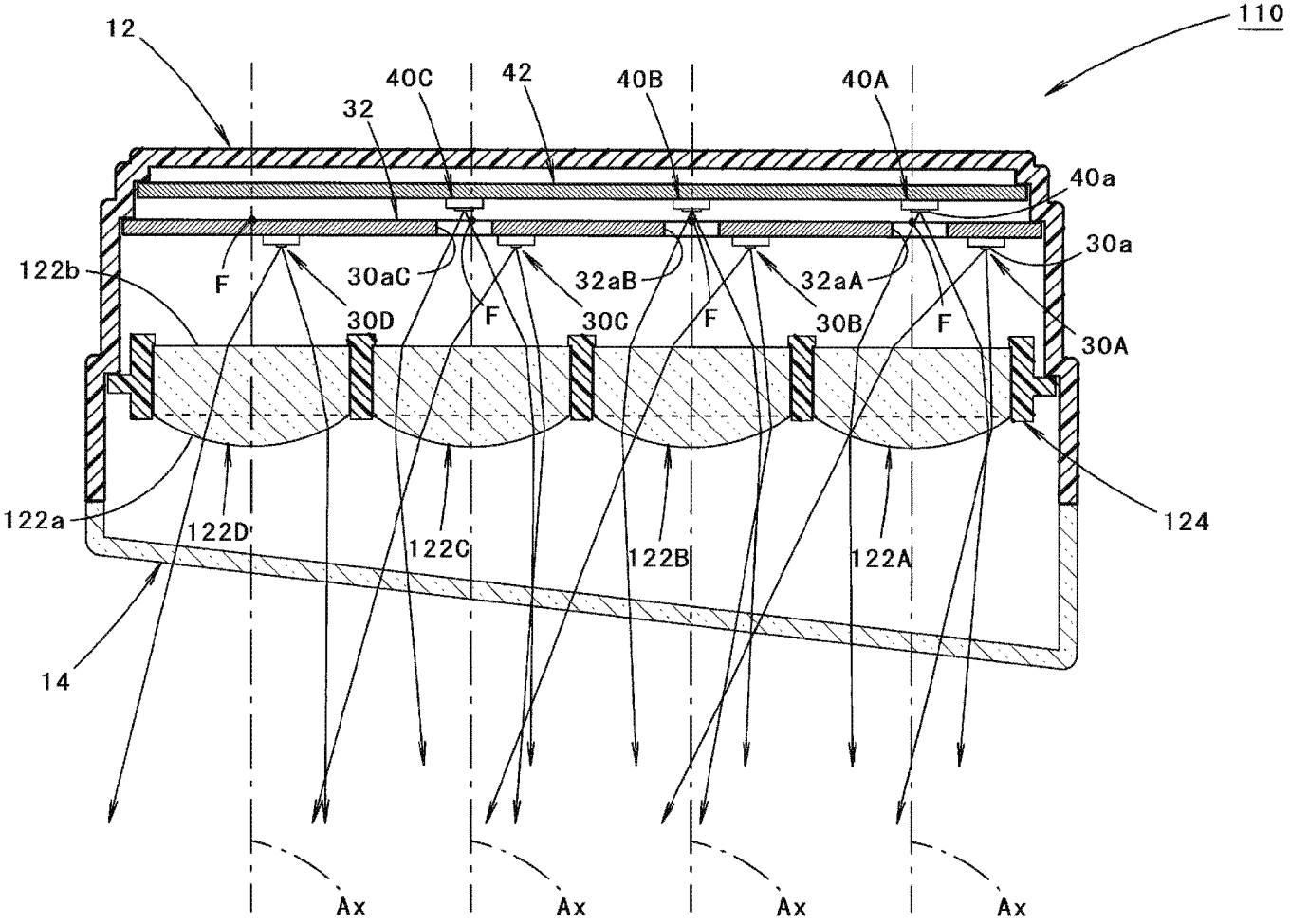
FIG. 8 is a view similar to FIG. 2, showing a first modification of the embodiment.

FIG. 8 is a view similar to FIG. 2, showing a vehicle lamp 110 according to the present modification.

As shown in FIG. 8, a basic configuration of the vehicle lamp 110 is the same as that of the vehicle lamp 10 according to the above embodiment, but the present modification is different from the above embodiment in that independent four projection lenses 122A, 122B, 122C, 122D are supported on the lamp body 12 via a common lens support member 124.

Each of the projection lenses 122A to 122D is configured as a plano-convex lens in which a front surface 122*a* is formed in a spherical shape and a rear surface 122*b* is formed in a planar shape.

The lens support member 124 is formed so as to surround the periphery of each of the projection lenses 122A to 122D and is supported on the lamp body 12 at both left and right ends thereof.

Also in the case of employing the configuration of the present modification, it is possible to form the second light distribution pattern PR2 with a compact configuration, similar to the case of the above embodiment.

Next, a second modification of the above embodiment will be described.

Figure 9:
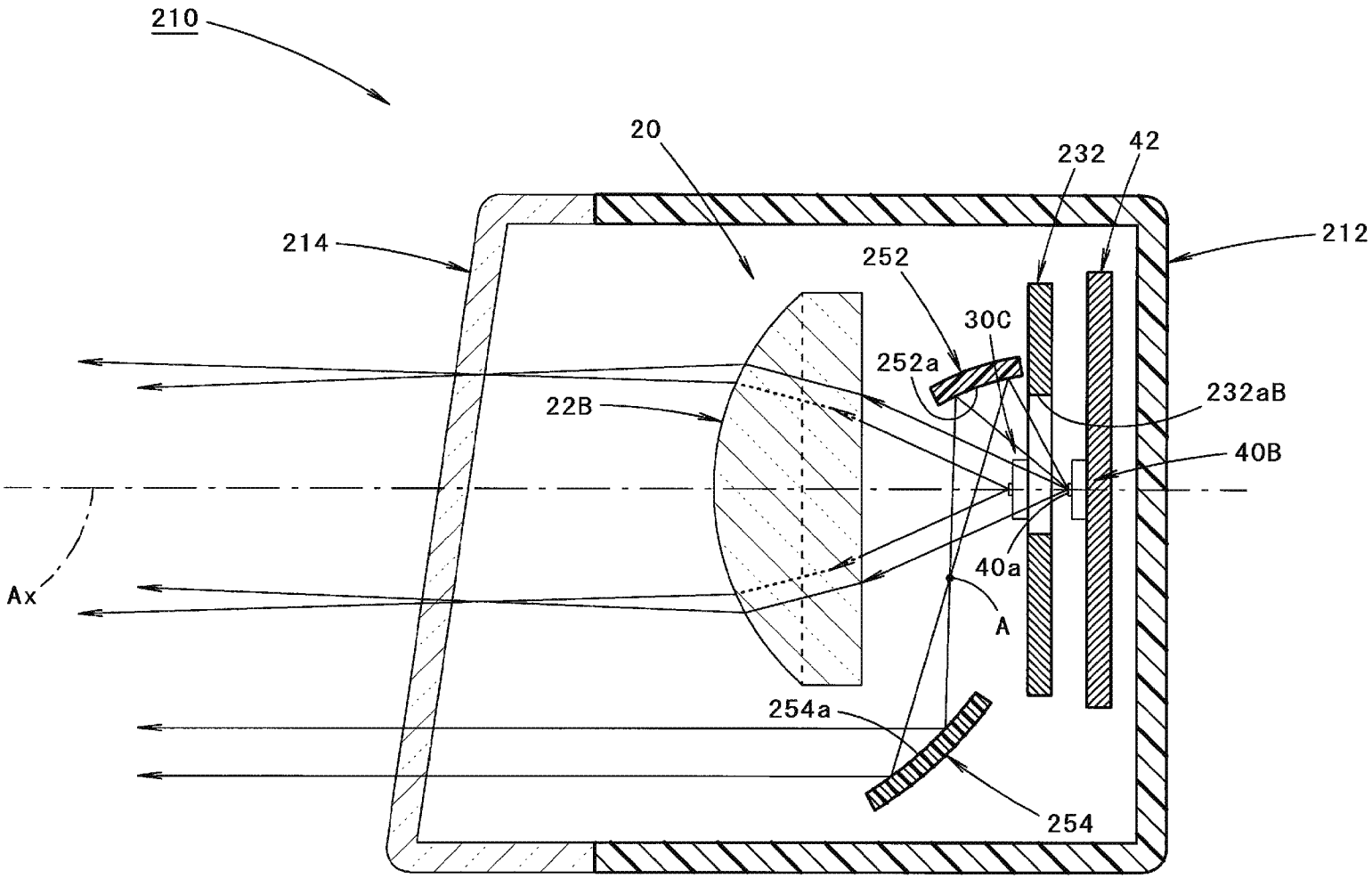
FIG. 9 is a view similar to FIG. 3, showing a second modification of the embodiment.

FIG. 9 is a view similar to FIG. 3, showing a vehicle lamp 210 according to the present modification.

As shown in FIG. 9, a basic configuration of the vehicle lamp 210 is the same as that of the vehicle lamp 10 according to the above embodiment. However, a configuration of a light source support member 232 in the present modification is partially different from that in the above embodiment. Further, the present modification is different from the above embodiment in that first and second reflectors 252, 254 are additionally provided between the transparent member 20 and the light source support member 232. Meanwhile, along with this, shapes of a lamp body 212 and a translucent cover 214 in the present modification are partially different from those in the above embodiment.

The first and second reflectors 252, 254 are arranged at three positions so as to respectively correspond to the three projection lenses 22A to 22C. Each of these three sets of first and second reflectors 252, 254 is integrally formed and is supported on the lamp body 212 at both left and right ends thereof.

The first and second reflectors 252, 254 arranged corresponding to the projection lens 22B are shown in FIG. 9.

The first reflector 252 is disposed above the optical axis Ax of the projection lens 22B and the second reflector 254 is disposed below the optical axis Ax thereof.

The light source support member 232 is formed with a translucent part 232*a*B whose opening shape is expanded to the upper side than the translucent part 32*a*B formed in the light source support member 32 of the above embodiment. In this way, the light, which is emitted from the second light emitting element 40B and directed to the upper side than the projection lens 22B, reaches the first reflector 252.

The first reflector 252 has a reflecting surface 252*a* constituted by a spheroidal surface in which a light emission center of the light emitting surface 40*a* of the second light emitting element 40B is set as a first focal point and a point A located below the optical axis Ax in a portion between the transparent member 20 and the light source support member 232 is set as a second focal point.

On the other hand, the second reflector 254 has a reflecting surface 254*a* constituted by a paraboloid of revolution in which the point A is set as a focal point. Further, the second reflector 254 is configured to reflect the light, which is emitted from the second light emitting element 40B, reflected by the reflecting surface 252*a* of the first reflector 252 and converged to the point A, as a substantially parallel light, toward the front of the vehicle in the space below the projection lens 22B.

Figures 10A, 10B, 10C, 10D:
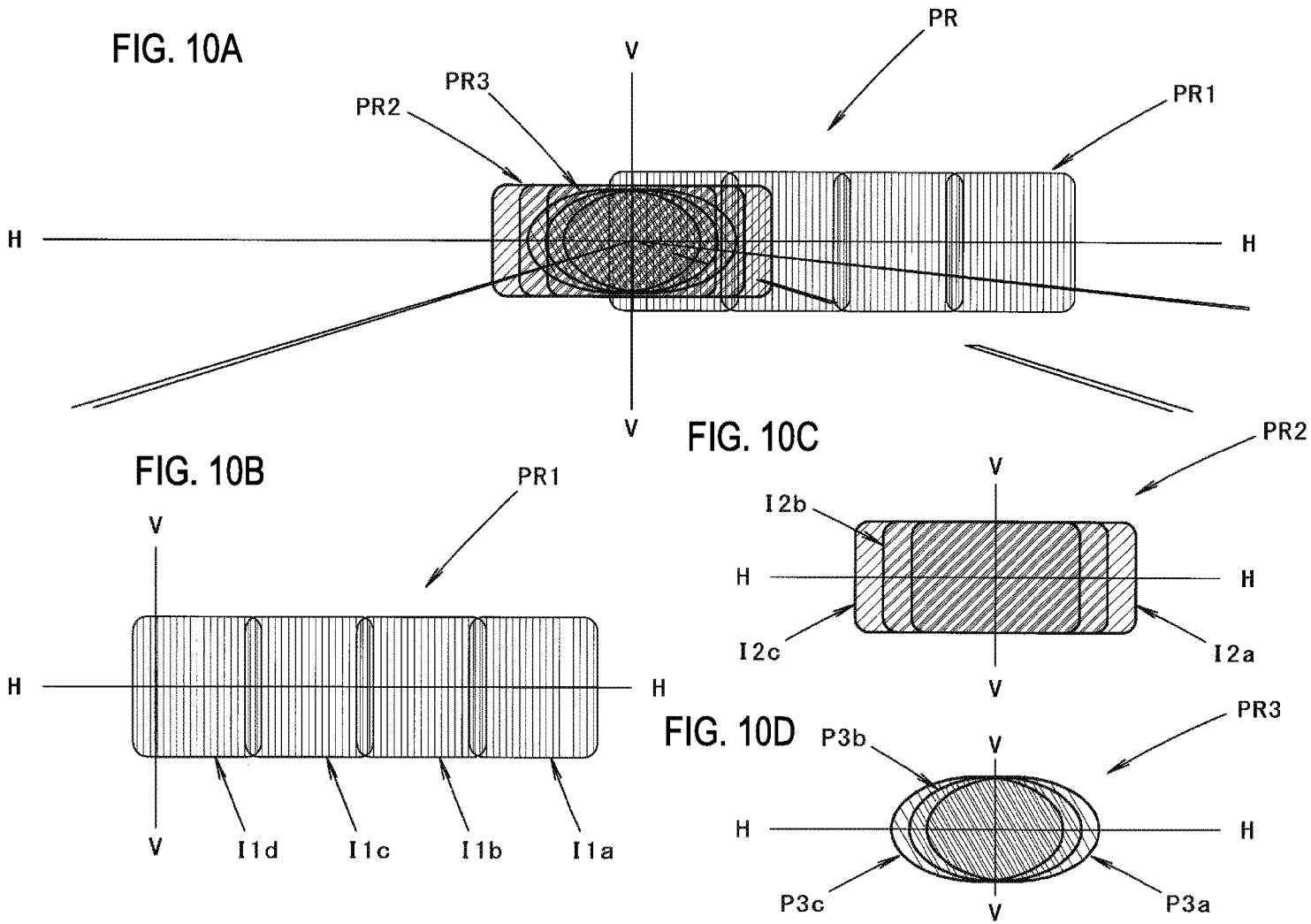
FIGS. 10A to 10D are views similar to FIGS. 5A to 5C, showing an operation of the second modification.

FIG. 10A is a view perspectively showing a high-beam light distribution pattern PR formed by the irradiation light from the vehicle lamp 210.

The high-beam light distribution pattern PR is formed as a combined light distribution pattern of a first light distribution pattern PR1 shown in FIG. 10B, a second light distribution pattern PR2 shown in FIG. 10C and a third light distribution pattern PR3 shown in FIG. 10D.

The third light distribution pattern PR3 shown in FIG. 10D is a light distribution pattern which is formed, together with the second light distribution pattern PR2 shown in FIG. 10C, when three second light emitting elements 40A to 40C are simultaneously turned on. The third light distribution pattern PR3 is composed of three light distribution patterns P3*a*, P3*b*, P3*c* which are formed by the light reflected from three sets of first and second reflectors 252, 254. The third light distribution pattern PR3 is formed as a spot-like light distribution pattern centered on the point H-V.

Also in the case of employing the configuration of the present modification, it is possible to form the second light distribution pattern PR2 with a compact configuration, similar to the case of the above embodiment.

Furthermore, in the present modification, the spot-like third light distribution pattern PR3 is additionally formed. Therefore, it is possible to further enhance the visibility on a distant area of the travelling road in front of the vehicle.

Meanwhile, instead of forming the third light distribution pattern PR3 as a spot-like light distribution pattern by the light reflected from the second reflector 254 as in the present modification, it is also possible to form the third light distribution pattern PR3 as a light distribution pattern which diffuses in a horizontal direction. For example, a low-beam light distribution pattern may be formed by the irradiation light from another lamp unit (not shown), and then, a diffusion area of the low-beam light distribution pattern may be formed by the light reflected from the second reflector 254.

Next, a third modification of the above embodiment will be described.

Figure 11:
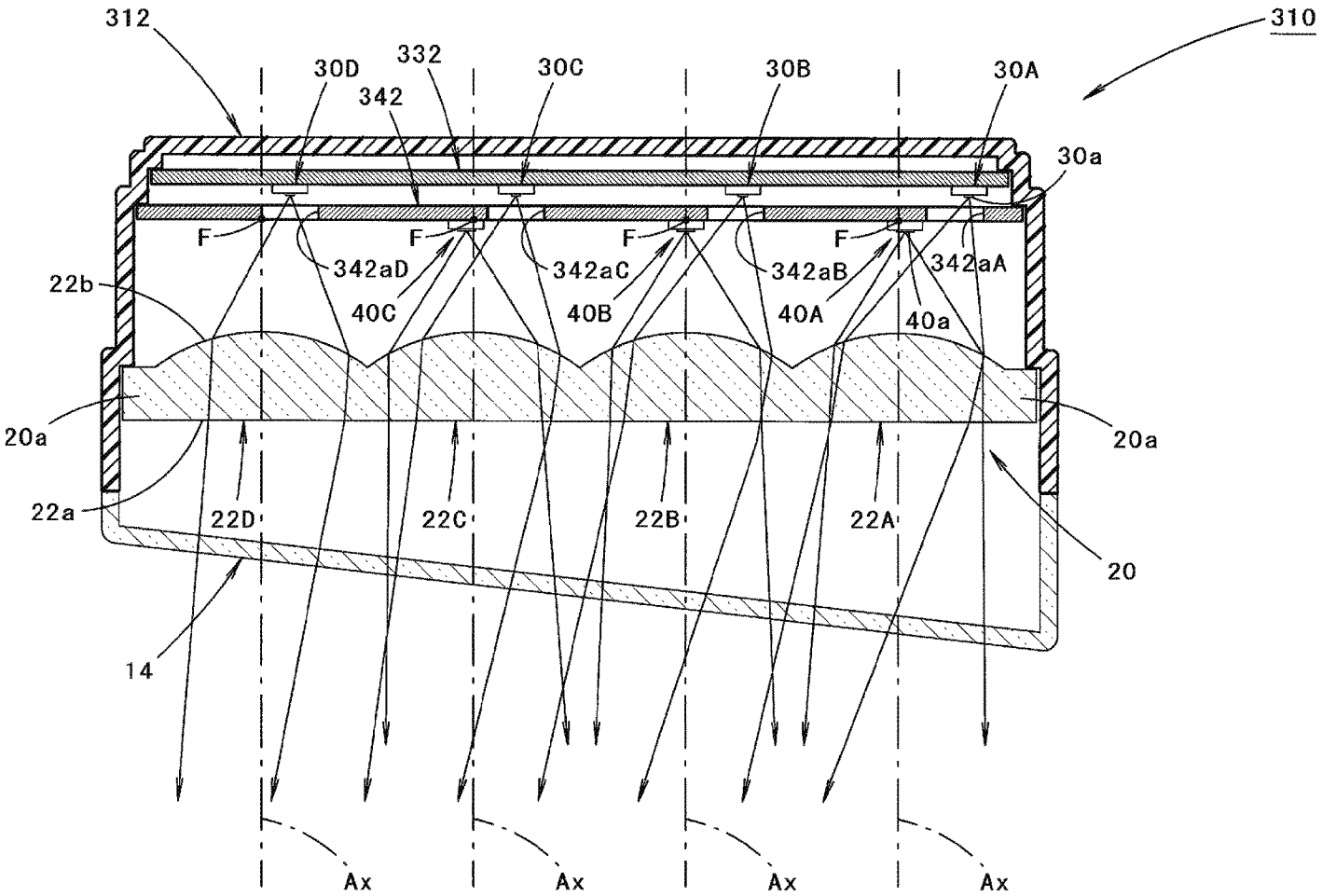
FIG. 11 is a view similar to FIG. 2, showing a third modification of the embodiment.

FIG. 11 is a view similar to FIG. 2, showing a vehicle lamp 310 according to the present modification.

As shown in FIG. 11, a basic configuration of the vehicle lamp 310 is the same as that of the vehicle lamp 10 according to the above embodiment. However, in the present modification, the positional relationship among four first light emitting elements 30A, 30B, 30C, 30D and three second light emitting elements 40A, 40B, 40C is reversed before and after.

Along with this, the positional relationship between a common light source support member 332 for supporting the four first light emitting elements 30A to 30D and a common light source support member 342 for supporting the three second light emitting elements 40A, 40B, 40C is also reversed before and after. Further, the light source support member 342 is formed with translucent parts 342*a*A, 342*a*B, 342*a*C, 342*a*D at four places at intervals in the vehicle width direction. The translucent parts 342*a*A, 342*a*B, 342*a*C, 342*a*D allow the light emitted from each of the first light emitting elements 30A to 30D to be transmitted forward therethrough and thus to be inputted on each of the projection lenses 22A to 22D.

At that time, the forward displacement amount of the light emitting surface 40*a* of each of the second light emitting elements 40A to 40C from the rear focal point F is set to a value smaller than the rearward displacement amount of the light emitting surface 30*a* of each of the first light emitting elements 30A to 30D from the rear focal point F. In order to realize this setting, a lamp body 312 of the present modification has a depth dimension slightly larger than the lamp body 12 of the above embodiment.

In the present modification, a first light distribution pattern substantially similar to the first light distribution pattern PR1 of the above embodiment is formed by simultaneously turning on the four first light emitting elements 30A to 30D, and a second light distribution pattern substantially similar to the second light distribution pattern PR2 of the above embodiment is formed by simultaneously turning on the three second light emitting elements 40A to 40C.

Also in the case of employing the configuration of the present modification, it is possible to form the second light distribution pattern PR2 with a compact configuration, similar to the case of the above embodiment.

Next, a fourth modification of the above embodiment will be described.

Figure 12:
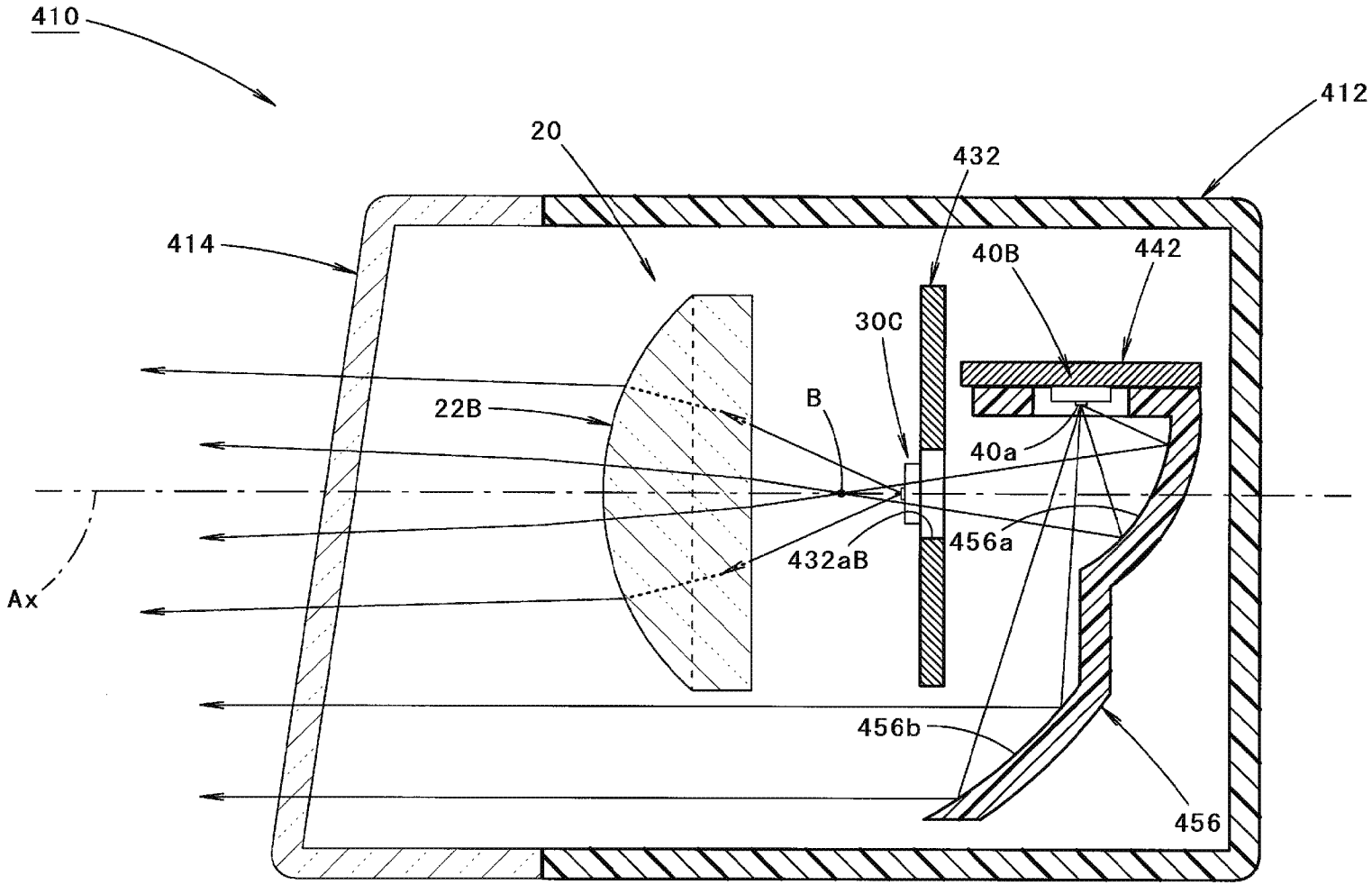
FIG. 12 is a view similar to FIG. 3, showing a fourth modification of the embodiment.

FIG. 12 is a view similar to FIG. 3, showing a vehicle lamp 410 according to the present modification.

As shown in FIG. 12, a basic configuration of the vehicle lamp 410 is the same as that of the vehicle lamp 10 according to the above embodiment. However, the present modification is different from the above embodiment in that three second light emitting elements 40A, 40B, 40C (only the second light emitting element 40B is shown in FIG. 12) are supported on a common light source support member 442 with the light emitting surfaces 40*a* thereof facing downward and a third reflector 456 is respectively arranged at a position corresponding to each of the three second light emitting elements 40A, 40B, 40C and below the light source support member 442.

Meanwhile, along with this, an outer shape of a light source support member 432 and shapes of a lamp body 412 and a translucent cover 414 in the present modification are partially different from the above embodiment.

The third reflectors 456 arranged at three places are integrally formed with each other and supported on the lamp body 412 at both left and right ends thereof.

Each of the third reflectors 456 has an upper reflecting surface 456*a* disposed at a position straddling up and down the optical axis Ax and a lower reflecting surface 456*b* disposed at an obliquely front lower side of the upper reflecting surface 456*a*.

The upper reflecting surface 456*a* is constituted by a spheroidal surface in which a light emission center of the light emitting surface 40*a* of the second light emitting element 40B is set as a first focal point and a point B located on the optical axis Ax and on the front side of the light source support member 432 is set as a second focal point. Further, the upper reflecting surface 456*a* reflects the light emitted from the second light emitting element 40B as a convergent light directed toward the point B, so that the light reaches the projection lens 22B through the translucent part 432*a*B.

The lower reflecting surface 456*b* is constituted by a paraboloid of revolution in which the light emission center of the light emitting surface 40*a* of the second light emitting element 40B is set as a focal point. Further, the lower reflecting surface 456*b* is adapted to reflect the light emitted from the second light emitting element 40B, as a substantially parallel light, toward the front of the vehicle in the space below the projection lens 22B.

The light source support member 432 of the present modification is configured such that a position of a lower end edge is set to a position higher than the light source support member 32 of the above embodiment in order to prevent the light reflected from the lower reflecting surface 456*b* from being inadvertently shielded.

Then, in the present modification, a high-beam light distribution pattern substantially similar to the high-beam light distribution pattern PR shown in FIG. 10A is formed by the irradiation light from the vehicle lamp 410.

Therefore, also in the case of employing the configuration of the present modification, it is possible to form the second light distribution pattern PR2 with a compact configuration, similar to the case of the above embodiment. Further, similar to the case of the third modification, the spot-like third light distribution pattern PR3 is additionally formed, and thus, it is possible to further enhance the visibility on a distant area of the travelling road in front of the vehicle.

Next, a fifth modification of the above embodiment will be described.

Figure 13:
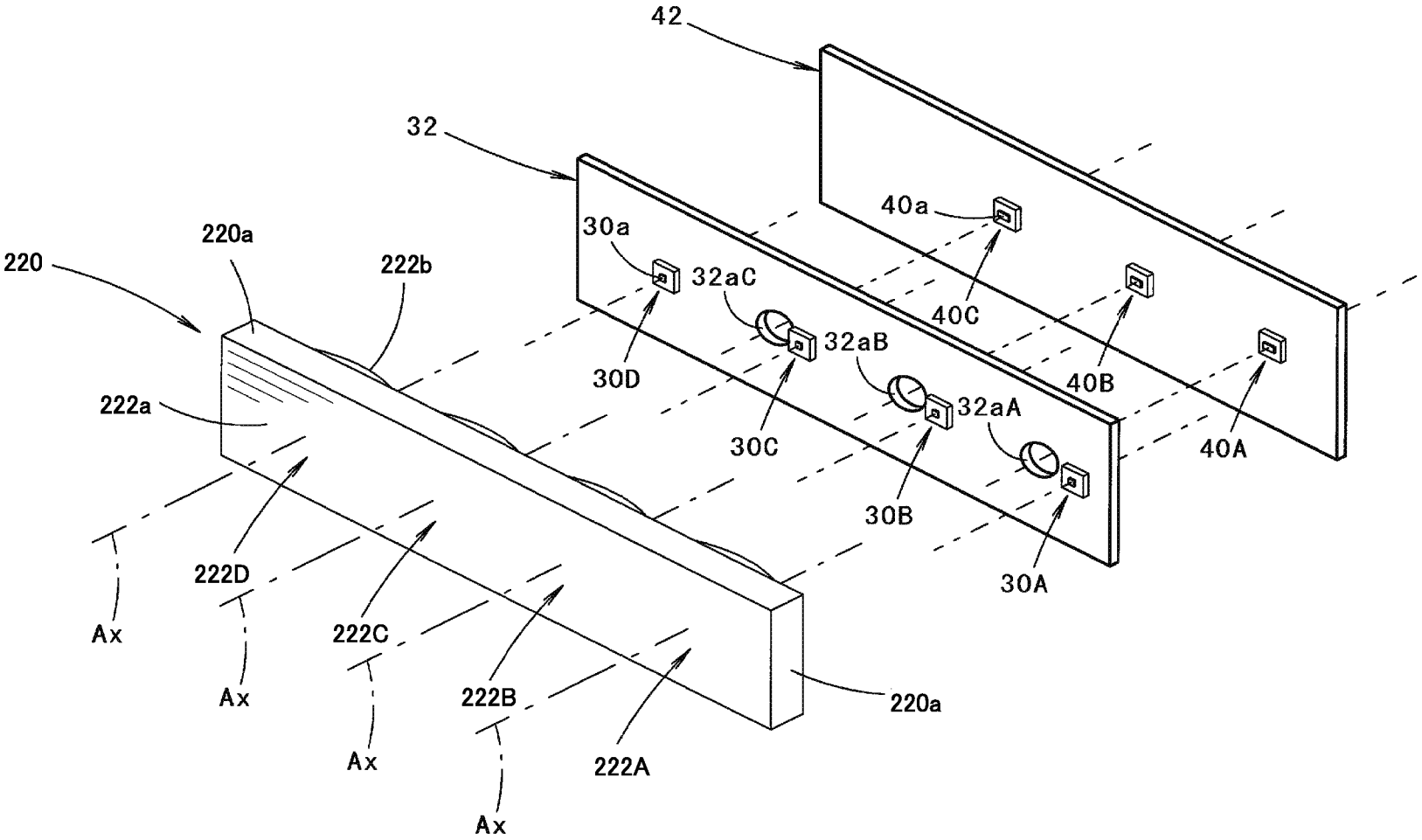
FIG. 13 is a view similar to FIG. 4, showing a fifth modification of the embodiment.

FIG. 13 is a view similar to FIG. 4, showing main components of a vehicle lamp according to the present modification.

As shown in FIG. 13, a basic configuration of this vehicle lamp is the same as that of the vehicle lamp 10 according to the above embodiment, but configurations of four projection lenses 222A, 222B, 222C, 222D in the present modification are different from those in the above embodiment.

Also in the present modification, the four projection lenses 222A to 222D are configured as a single transparent member 220, and flange portions 220*a* are formed at both left and right ends of the transparent member 220.

Each of the projection lenses 222A to 222D is configured as a plano-convex lens in which a front surface 222*a* is formed in a planar shape and a rear surface 222*b* is formed in a spherical shape. However, each of the projection lenses 222A to 222D has the same optical function as each of the projection lenses 22A to 22D of the above embodiment. Further, a front surface of the transparent member 220 is configured as a single planar surface in which the front surfaces 222*a* of the four projection lenses 222A to 222D are continuous.

Also in the case of employing the configuration of the present modification, it is possible to form the second light distribution pattern PR2 with a compact configuration, similar to the case of the above embodiment.

Further, also in the present modification, the four projection lenses 222A to 222D are configured as the single transparent member 220. Therefore, it is possible to reduce the number of parts, and also, it is possible to improve the positional relationship accuracy among the projection lenses 222A to 222D. Furthermore, the front surface of the transparent member 220 is configured as a single planar surface in which the front surfaces 222*a* of the four projection lenses 222A to 222D are continuous. Therefore, when observing the vehicle lamp from the outside, the presence of the four projection lenses 222A to 222D can be made inconspicuous, and thus, the design properties thereof can be improved.

Next, a sixth modification of the above embodiment will be described.

Figure 14:
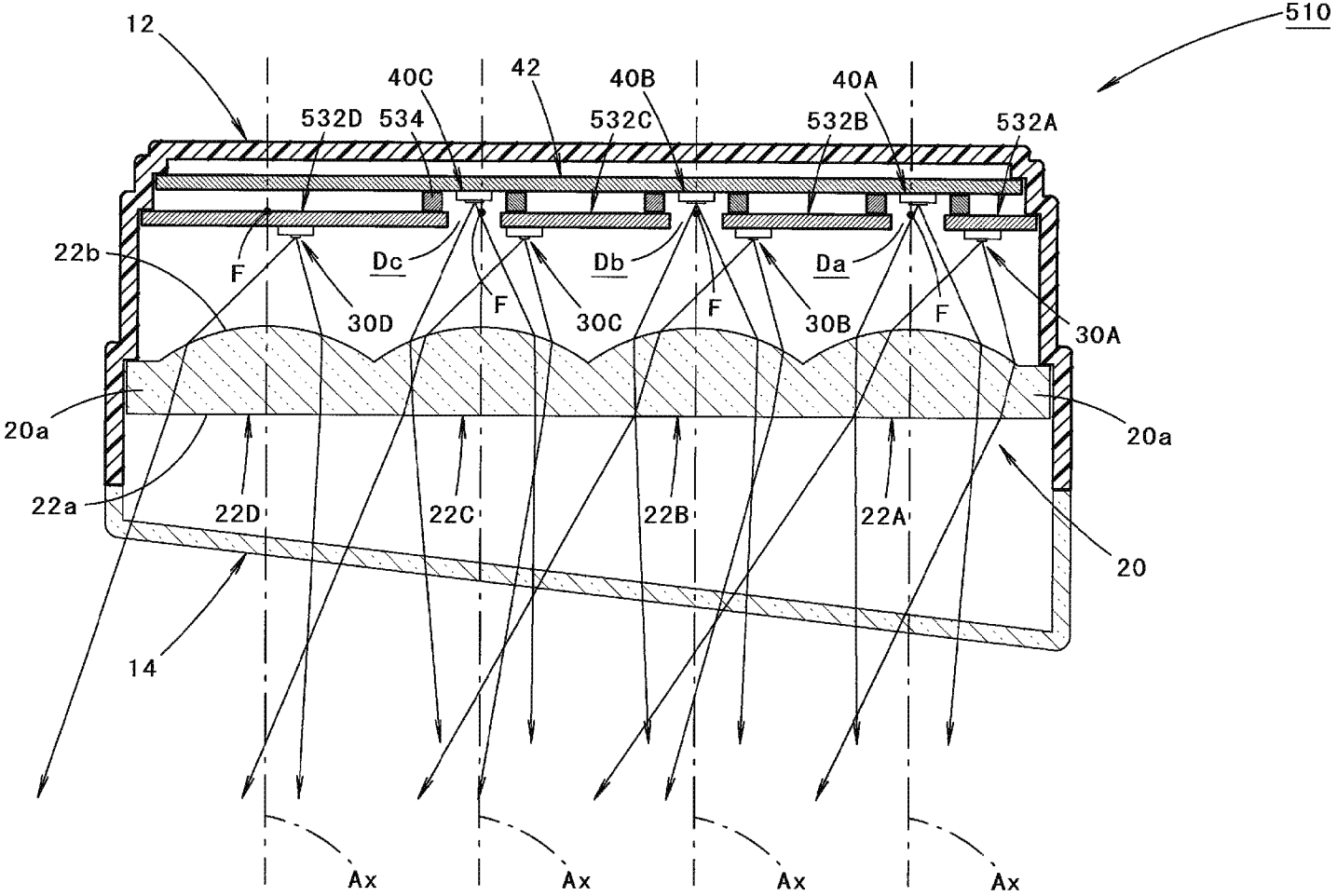
FIG. 14 is a view similar to FIG. 2, showing a sixth modification of the embodiment.

FIG. 14 is a view similar to FIG. 2, showing a vehicle lamp 510 according to the present modification.

As shown in FIG. 14, a basic configuration of this vehicle lamp 510 is the same as that of the vehicle lamp 10 according to the above embodiment. However, the present modification is different from the above embodiment in that each of the four first light emitting elements 30A, 30B, 30C, 30D is supported by each of four light source support members 532A, 532B, 532C, 532D, instead of the light source support member 32 of the above embodiment.

The four light source support members 532A to 532D are arranged at intervals in the vehicle width direction, and the light emitted from each of the second light emitting elements 40A to 40C is inputted on each of the projection lenses 22A to 22C through each of gaps Da, Db, Dc formed at three places therebetween.

Meanwhile, the four light source support members 532A to 532D are supported on the lamp body 12 or the light source support member 42. At that time, the support to the light source support member 42 is performed via a spacer 534.

Also in the case of employing the configuration of the present modification, it is possible to form the second light distribution pattern PR2 with a compact configuration, similar to the case of the above embodiment.

Meanwhile, the numerical values represented as specifications in the above embodiment and the modifications thereof are merely examples and may be set to different values as appropriate.

Further, the present invention is not limited to the configurations described in the above embodiment and the modifications thereof. Various other modifications besides these configurations may be applied to the present invention.

What is claimed is:

1. A vehicle lamp comprising:

a plurality of projection lenses arranged in parallel in a certain direction intersecting a vehicle longitudinal direction;

a plurality of first light emitting elements arranged behind the plurality of projection lenses in the vehicle longitudinal direction;

a common light source support member configured to support the plurality of first light emitting elements, the light source support member including at least one translucent part, transparent part, or through hole; and at least one second light emitting element disposed behind the common light source support member in the vehicle longitudinal direction, wherein a first light distribution pattern is formed by irradiating a direct light from each of the first light emitting elements toward the front through each of the projection lenses, and wherein a second light distribution pattern is formed by irradiating the light emitted from the at least one second light emitting element toward the front through the at least one translucent part, transparent part, or through hole of the common light source support member and any one of the plurality of projection lenses.

2. The vehicle lamp according to claim 1, wherein the at least one translucent part, transparent part, or through hole is a through hole formed in the light source support member.

3. The vehicle lamp according to claim 1, wherein the at least one second light emitting element includes a plurality of second light emitting elements arranged in parallel in the certain direction, and the at least one translucent part, transparent part, or through hole includes a plurality of translucent parts arranged in parallel in the certain direction.

4. The vehicle lamp according to claim 1, wherein each first light emitting element of the plurality of first light emitting elements is arranged adjacent to and in front of, in the vehicle longitudinal direction, a rear focal point of a respective projection lens of the plurality of projection lenses.

5. The vehicle lamp according to claim 1, wherein each first light emitting element of the plurality of first light emitting elements is arranged adjacent to an optical axis of a respective projection lens of the plurality of projection lenses, the plurality of first light emitting elements are arranged in parallel in the certain direction, and a distance between each first light emitting element of the plurality of first light emitting elements and the optical axis of the respective projection lens adjacent thereto decreases in order of the plurality of first light emitting elements along the certain direction.

6. The vehicle lamp according to claim 1, wherein the at least one second light emitting element includes three second light emitting elements arranged in parallel in the certain direction, and each second light emitting element of the three second light emitting elements is arranged adjacent to an optical axis of a respective projection lens of the plurality of projection lenses, the three second light emitting elements comprising:

a left-most second light emitting element having a center that is left of the optical axis of the respective projection lens adjacent thereto along an axis parallel to the certain direction, a right-most second light emitting element having a center that is right of the optical axis of the respective projection lens adjacent thereto along the axis, and a center second light emitting element having a center that is centered on the optical axis of the respective projection lens adjacent thereto along the axis.

7. The vehicle lamp according to claim 1, wherein the at least one second light emitting element includes a plurality of second light emitting elements arranged in parallel in the certain direction, each second light emitting element of the plurality of second light emitting elements is arranged adjacent to an optical axis of a respective projection lens of the plurality of projection lenses, and a distance between each second light emitting element of the plurality of first light emitting elements and the optical axis of the respective projection lens adjacent thereto decreases in order of the plurality of second light emitting elements along the certain direction.

8. The vehicle lamp according to claim 1, wherein the plurality of first light emitting elements and the at least one second light emitting element are configured to be turned on simultaneously.

* * * * *